US008714414B2

(12) United States Patent
Koons et al.

(10) Patent No.: US 8,714,414 B2
(45) Date of Patent: May 6, 2014

(54) ICE TRANSFER DEVICE

(75) Inventors: Bill J. Koons, Cedar Rapids, IA (US); David J. Olberding, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 896 days.

(21) Appl. No.: 12/612,147

(22) Filed: Nov. 4, 2009

(65) Prior Publication Data

US 2011/0101033 A1 May 5, 2011

(51) Int. Cl.
*G01F 11/10* (2006.01)

(52) U.S. Cl.
USPC ..... 222/370; 62/320

(58) Field of Classification Search
USPC ..... 222/370, 251, 146.6, 333, 345–346; 62/320, 337, 459; 141/351
See application file for complete search history.

(56) References Cited

U.S. PATENT DOCUMENTS

| | | | | |
|---|---|---|---|---|
| 3,075,363 | A | 1/1963 | Conto | |
| 3,101,872 | A | 8/1963 | Dickinson | |
| 3,207,366 | A | 9/1965 | Feistel, Jr. | |
| 3,747,363 | A | 7/1973 | Grimm | |
| 3,798,923 | A | 3/1974 | Pink et al. | |
| 3,874,559 | A | 4/1975 | Pink | |
| 3,881,642 | A | 5/1975 | Hoenisch | |
| 4,049,161 | A | 9/1977 | Kohl | |
| 4,123,918 | A | 11/1978 | Kohl et al. | |
| 4,158,426 | A | 6/1979 | Frohbieter | |
| 4,227,383 | A | 10/1980 | Horvay | |
| 4,930,685 | A | 6/1990 | Landers | |
| 5,683,011 | A * | 11/1997 | Miliani | 222/56 |
| 6,062,426 | A | 5/2000 | Bartholmey et al. | |
| 7,175,046 | B2 * | 2/2007 | Yao | 221/265 |
| 7,316,121 | B2 | 1/2008 | Lee et al. | |
| 7,743,622 | B2 * | 6/2010 | Fischer et al. | 62/344 |
| 8,220,283 | B2 * | 7/2012 | Meyerholtz et al. | 62/320 |
| 2007/0295755 | A1 * | 12/2007 | Kinzie et al. | 222/239 |

FOREIGN PATENT DOCUMENTS

| | | | |
|---|---|---|---|
| JP | 2194324 | A | 7/1990 |

* cited by examiner

*Primary Examiner* — Kevin P Shaver
*Assistant Examiner* — Robert Nichols, II

(57) ABSTRACT

An ice-containing member having a plurality of interior chambers separated by substantially radially-extending chamber walls. A base is disposed below the ice-containing member and includes an ice-dispensing aperture. A lid is adjacent to the ice-containing member and operable between a first position. The lid is in abutting contact with the ice-containing member and a second position. The lid is spaced a predetermined distance from the housing.

9 Claims, 8 Drawing Sheets

ICE TRANSFER DEVICE

BACKGROUND OF THE PRESENT INVENTION

The present invention generally relates to an ice transfer device, and more specifically, to an ice transfer device with a revolving chamber.

SUMMARY OF THE INVENTION

In one aspect of the present invention, an ice transfer device includes an ice-containing member having a plurality of interior chambers separated by substantially radially-extending chamber walls. A base is disposed below the ice-containing member and includes an ice-dispensing aperture. A lid is adjacent to the ice-containing member and operable between a first position wherein the lid is in abutting contact with the ice-containing member and a second position wherein the lid is spaced a predetermined distance from the chamber walls.

In another aspect of the present invention, an ice transfer device includes an ice-containing member having a cylindrical exterior shape and a plurality of interior chambers. A base is disposed below the ice-containing member and includes an ice-dispensing aperture. A housing extends over the ice-containing member. The housing generally conforms to the exterior shape of the ice-containing member. The housing includes an ice-receiving aperture vertically offset from the base aperture.

In yet another aspect of the present invention, a method of making ice through an ice dispenser includes forming a horizontally-rotating ice-containing member. A plurality of chambers are formed inside the ice-containing member that are defined by substantially radially-extending chamber walls. The ice-containing member is covered with a translocatable lid. An ice-receiving aperture is provided in the lid vertically offset from the base aperture. A base is provided below the ice-containing member, the base including an ice-dispensing aperture.

These and other features, advantages, and objects of the present invention will be further understood and appreciated by those skilled in the art upon studying the following specification, claims, and appended drawings.

DETAILED DESCRIPTION OF EMBODIMENTS

Figure 1:
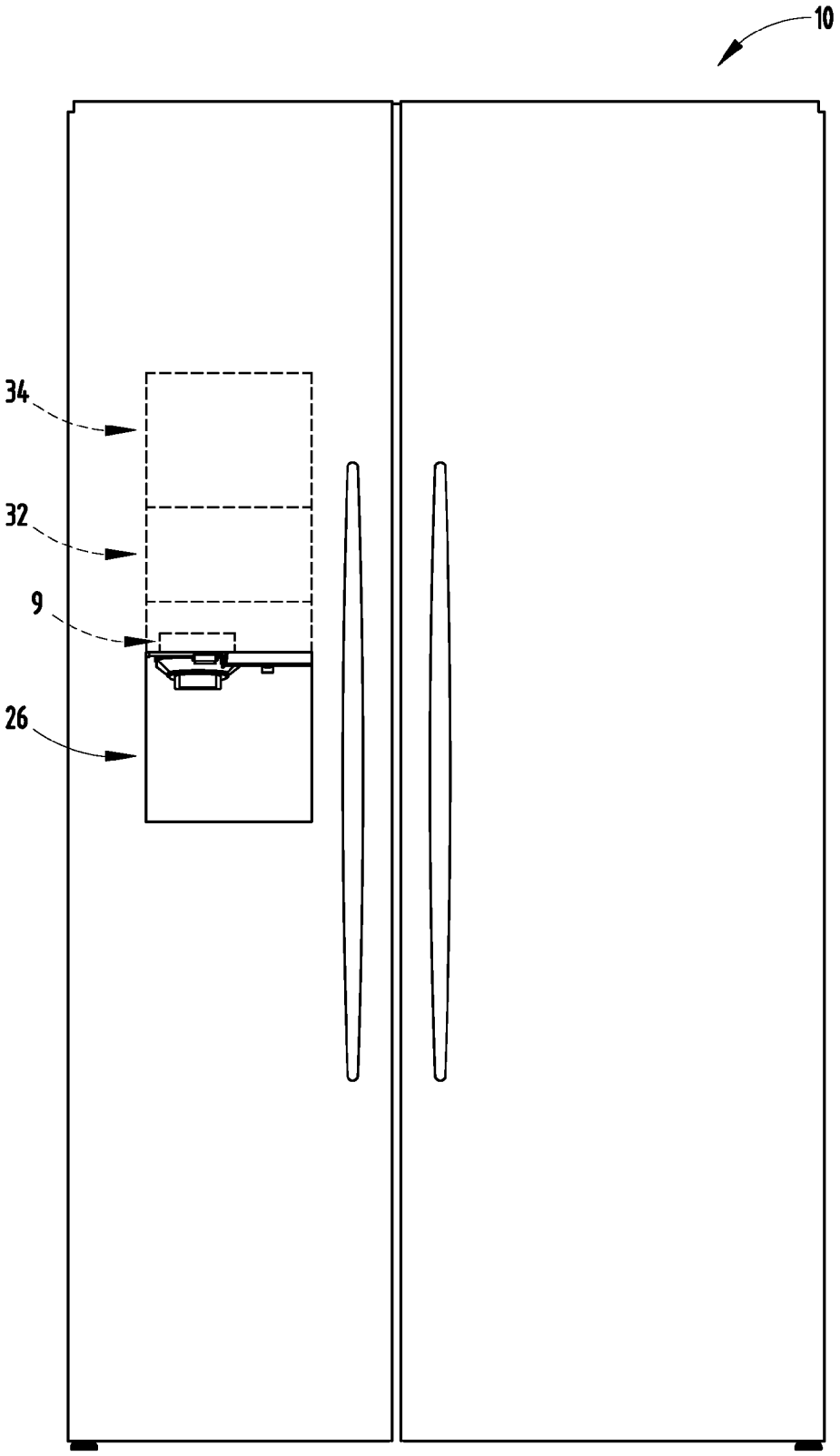
FIG. 1 is a front elevational view of one embodiment of a refrigerator according to the present invention.
Figure 2:
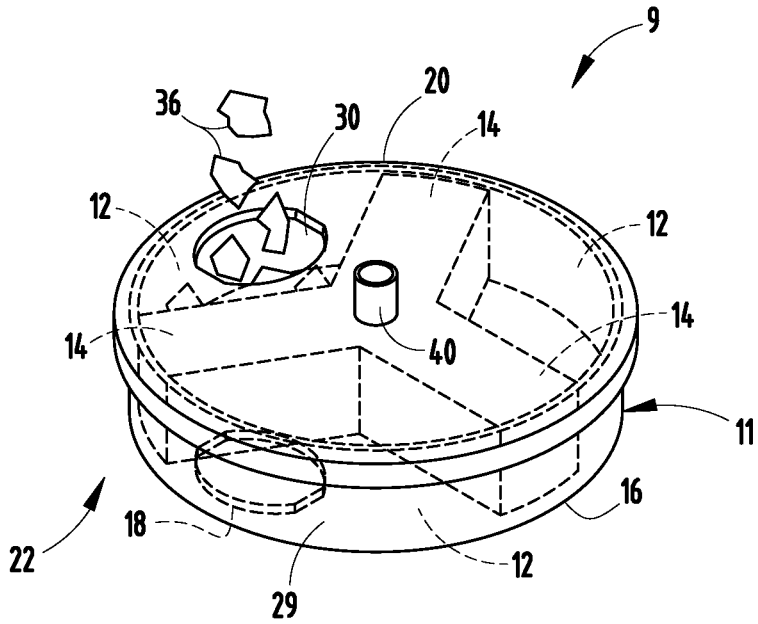
FIG. 2 is a top perspective view of one embodiment of an ice transfer device while receiving ice.

For purposes of description herein the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
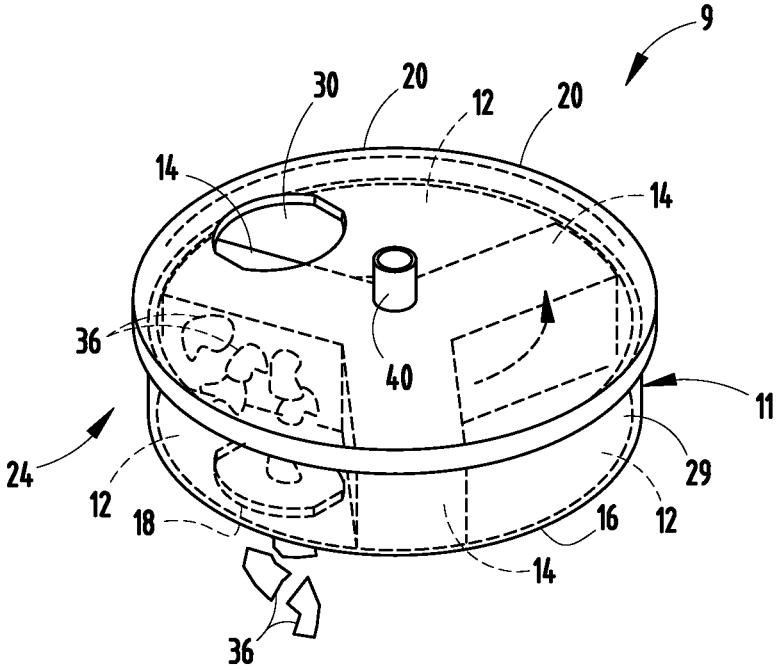
FIG. 3 is a top perspective view of the ice transfer device of FIG. 3 while dispensing ice.

Referring to the embodiment illustrated in FIG. 1-3, the reference numeral 10 generally designates an appliance that includes an ice transfer device 9 having an ice-containing member 11 with a plurality of interior chambers 12 separated by substantially radially-extending chamber walls 14. A base 16 is disposed below the ice-containing member 11 and includes an ice-dispensing aperture 18. A lid 20 is adjacent to the ice-containing member 11 and operable between a first position 22 wherein the lid 20 is in abutting contact with the ice-containing member and a second position 24 wherein the lid 20 is spaced a predetermined distance from the chamber walls 14.

Figure 4:
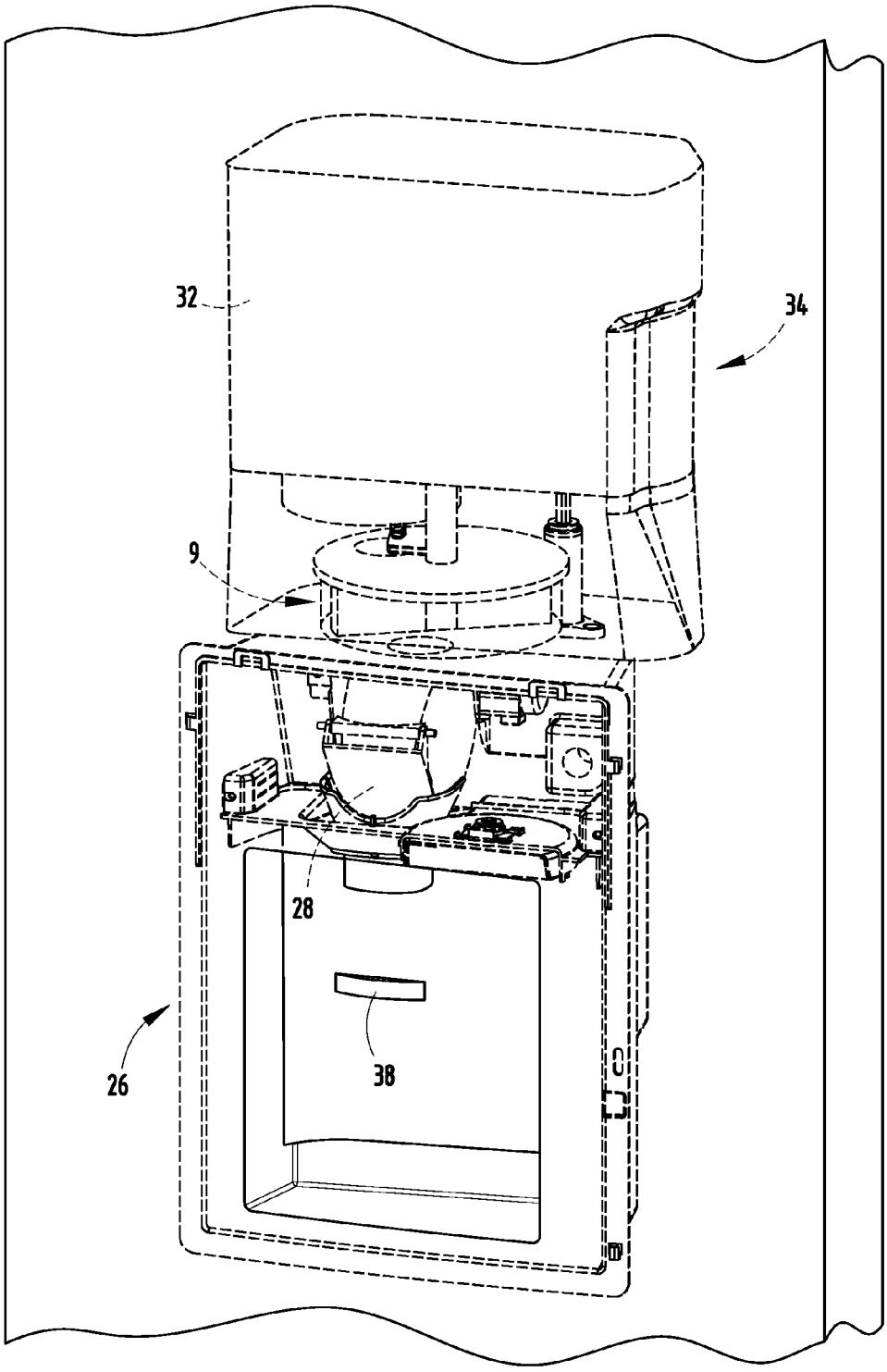
FIG. 4 is a top perspective view of an ice dispenser in an appliance door.
Figure 5A:
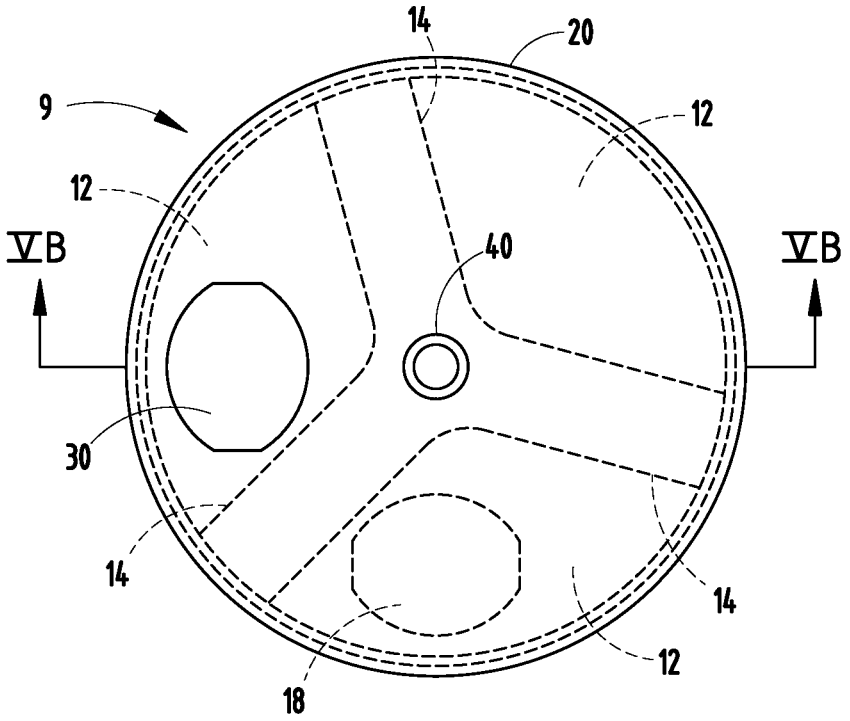
FIG. 5A is a top plan view of the ice dispenser of FIG. 3.
Figure 5B:
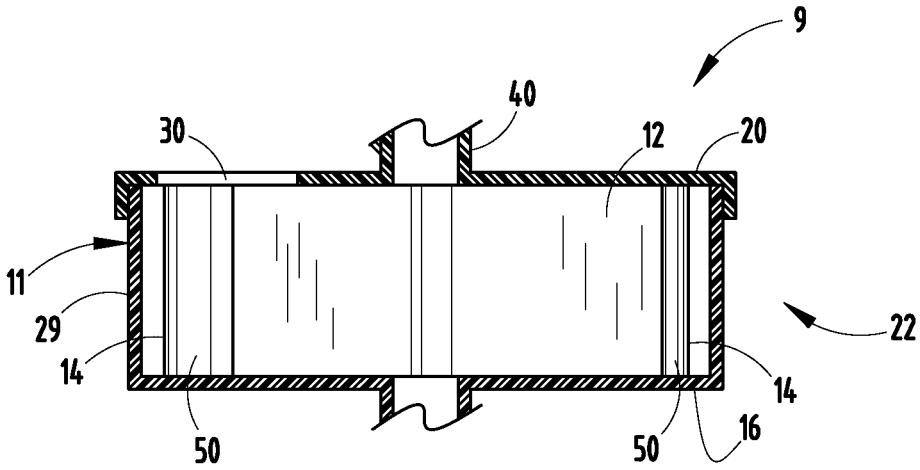
FIG. 5B is a side cross-sectional view of the ice dispenser of FIG. 5A taken at line VB-VB.

Referring now to the embodiment illustrated in FIGS. 2-4, the ice-containing member 11 is adapted for use over an ice dispenser 26 having a trap door 28. The ice-containing member 11 includes a sidewall 29 that rests on the base 16 to form a cylindrical configuration wherein the lid 20 is adapted for vertical translation relative to the chamber walls 14. The lid 20 includes an ice-receiving aperture 30 that is disposed generally substantially below an ice bin 32. The ice bin 32 receives and stores ice from an ice-maker 34 operably connected with the ice bin 32. When a user desires ice 36, and activates an actuator 38 in the appliance 10, the ice bin 32 deposits ice 36 that is generated in the ice-maker 34 through the ice-receiving aperture 30 into one of the plurality of interior chambers 12. The ice 36 cascades into the chamber 12 onto the base 16 until the amount of ice reaches a predetermined maximum volume. The maximum volume is determined based on data collected from a weight sensor, ice level sensor, etc. After the predetermined maximum volume has been reached, or if the user deactivates the actuator before the predetermined maximum level can be reached, the chamber walls 14 rotate counter-clockwise in the direction of arrow 40, which consequently rotates the ice 36 disposed in the ice-filled interior chamber 12. As the chamber walls 14 rotate, the ice 36 is moved over the base 16 and eventually slides over the ice-dispensing aperture 18 disposed above the trapdoor 28 of the ice dispenser 26. The ice 36 cascades downward through the ice-dispensing aperture 18, through the trapdoor 28 and out of the ice dispenser 26 into the waiting cup of a user. If more ice 36 is desired, then the process outlined above repeats until sufficient ice 36 has been dispensed to the user or until the ice bin 32 has been emptied.

Figure 6A:
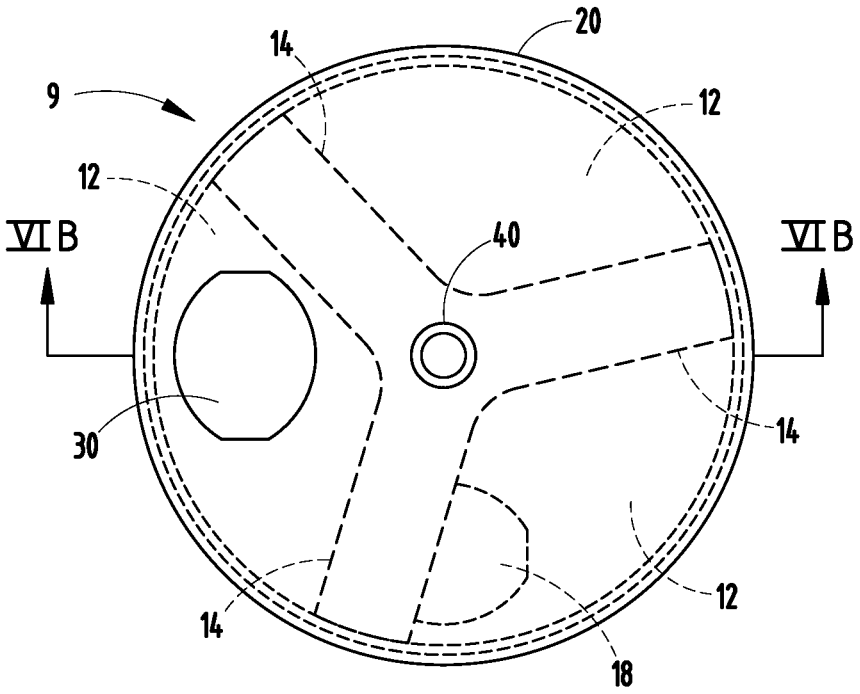
FIG. 6A is a top plan view of the ice dispenser with the lid raised during rotation of the chamber walls.
Figure 6B:
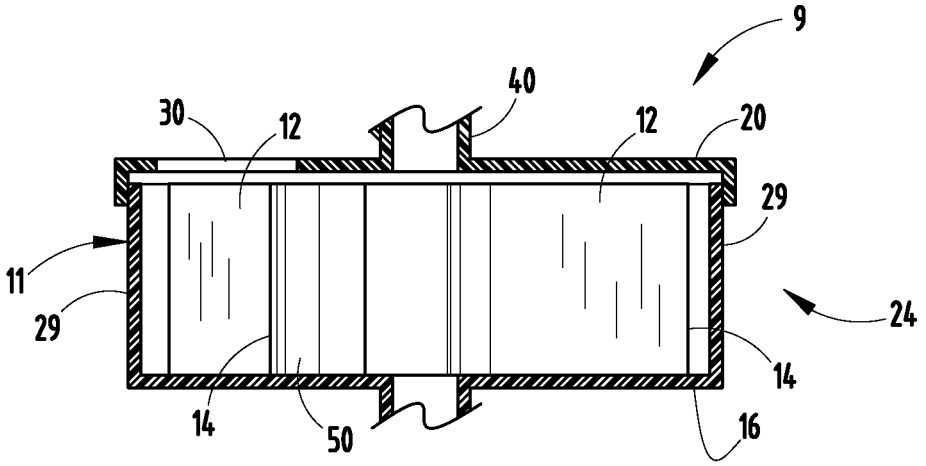
FIG. 6B is a side cross-sectional view of the ice dispenser of FIG. 6A taken at line VIB-VIB.

Referring again to FIGS. 5A, 5B, 6A, and 6B, the ice-containing member 11 is rotatably connected with a vertically-extending pivot pin 40 that allows for rotational movement of the ice-containing member 11. The pivot pin 40 may extend upward from the lid 20, downward from the base 16 or both. The lid 20 is adapted to move vertically upward and downward relative to the chamber walls 14 and sidewall 29. During use, the lid 20 elevates slightly (FIG. 6B) to minimize frictional resistance between the rotating chamber walls 14 and the lid 20. After the chamber walls 14 have stopped rotating, the lid 20 descends into abutting contact with the chamber walls 14. The combination of the lid 20, chamber walls 14 and the base 16, provide an efficient thermal barrier that minimizes the amount of cool air that leaves the appliance 10, while at the same time minimizing the amount of warm air that enters the appliance 10.

Figure 7:
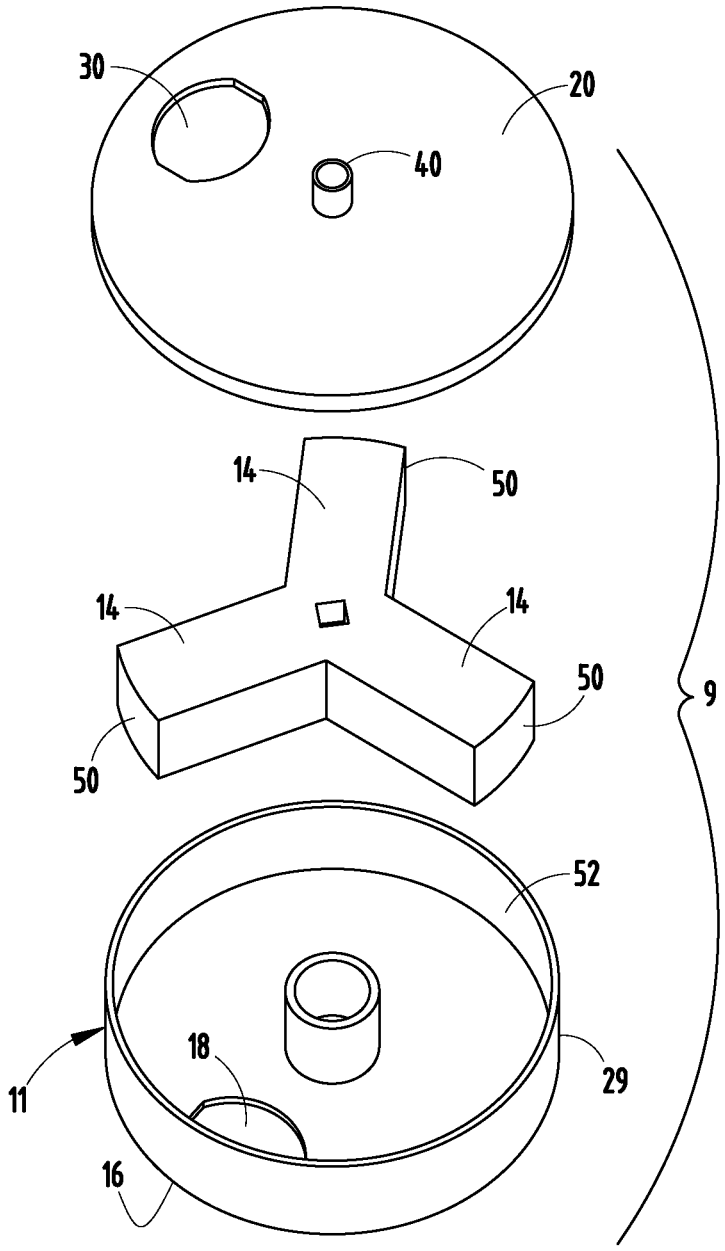
FIG. 7 is a top perspective exploded view of the ice dispenser of FIG. 3.

Referring to FIG. 7, the chamber walls 14 are arranged symmetrically inside the ice-containing member 11 and are specifically designed to direct ice from the chamber 14 out of and through the ice-dispensing aperture 18. Each chamber wall 14 includes an arcuate outer end 50 that complements the interior circumferential area 52 of the sidewall 29. In another embodiment, the lid 20 is sealed against the sidewall 29 with the chamber walls 14 disposed between the lid 20 and the housing 29.

Figure 8:
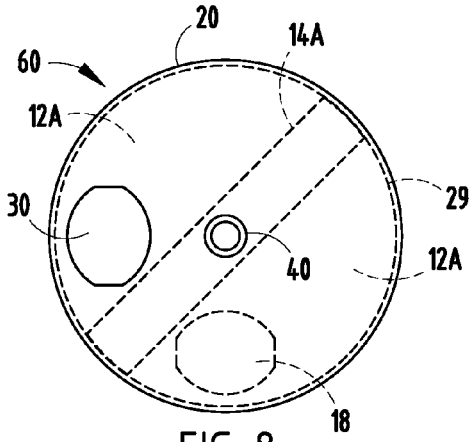
FIG. 8 is a top plan view of another embodiment of an ice dispenser.
Figure 9:
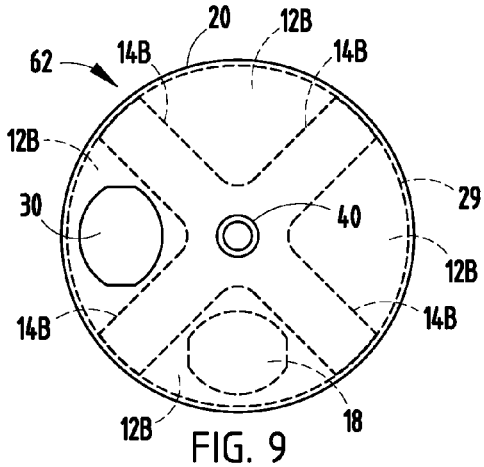
FIG. 9 is a top plan view of another embodiment of an ice dispenser.
Figure 10:
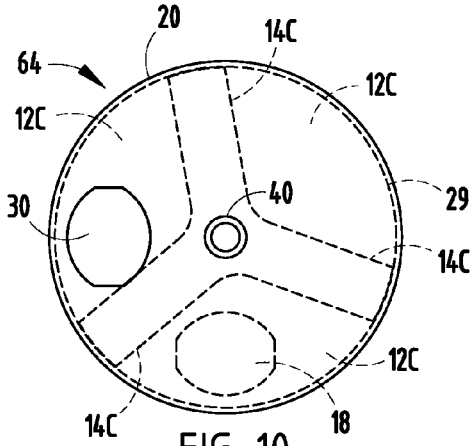
FIG. 10 is a top plan view of another embodiment of an ice dispenser.
Figure 11:
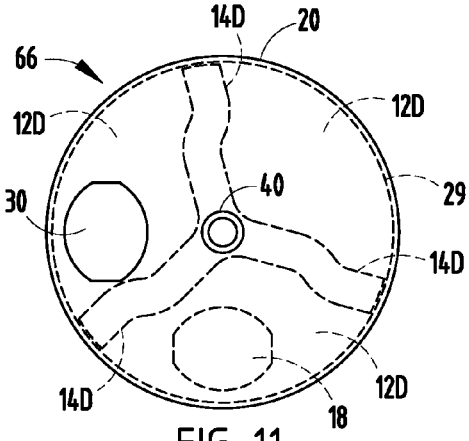
FIG. 11 is a top plan view of another embodiment of an ice dispenser.
Figure 12:
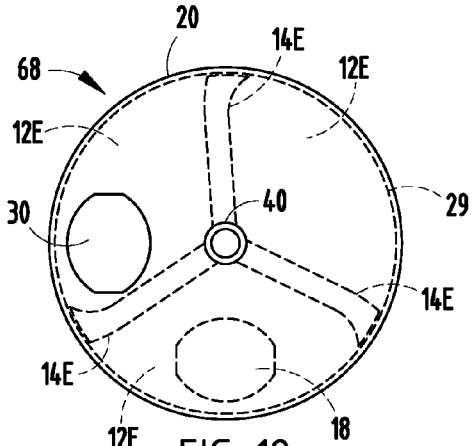
FIG. 12 is a top plan view of another embodiment of an ice dispenser.
Figure 13:
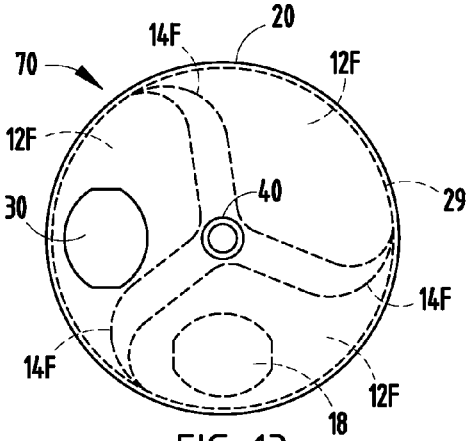
FIG. 13 is a top plan view of another embodiment of an ice dispenser.

As shown in the illustrated embodiments of FIGS. 8-13, the chamber walls 14 of the ice-transfer device 9 may have various configurations. FIG. 8 illustrates a linear chamber wall construction 60 wherein the chamber walls 14A effectively dispense ice using two chambers 12A. FIG. 9 illustrates a second linear chamber wall construction 62 with four chamber walls 14B that effectively dispense ice using four chambers 12B. FIG. 10 illustrates yet another linear chamber wall construction embodiment 64 that includes three chambers 12C with three linear chamber walls 14C. FIG. 11 illustrates an offset chamber wall construction 66 that is a variation of the embodiment of FIG. 10 with chamber walls 14D that include an offset portion that form offset chambers 12D. The chamber walls 14D of FIG. 11 are designed to provide additional guidance of ice 36 to the ice-dispensing aperture 18. FIG. 12 illustrates a sweeper wall construction 68 that is another variation of the embodiment illustrated in FIG. 10, with chambers 12E separated by thin chamber walls 14E that also include a thick flanged end 69. FIG. 13 illustrates an arcuate wall construction 70 having three chambers 12F, that are divided by arcuate chamber walls 14F that include an arcuate portion. It will be understood by a person having ordinary skill in the art that any number of possible configuration could be used and that the end use may define which embodiment is most beneficial to a user.

Figure 14:
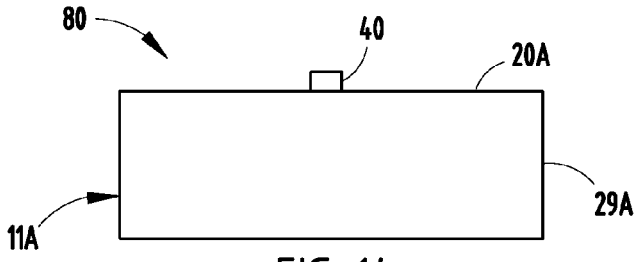
FIG. 14 is a side elevational view of one embodiment of an ice dispenser side profile configuration.
Figure 15:
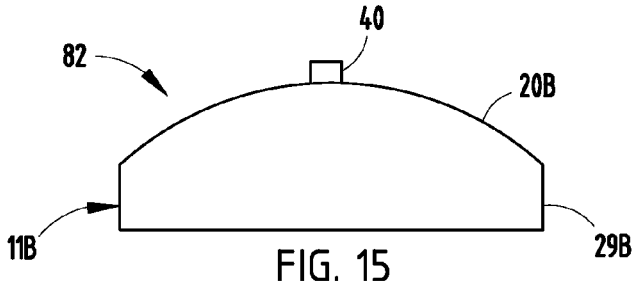
FIG. 15 is a side elevational view of another embodiment of an ice dispenser side profile configuration.
Figure 16:
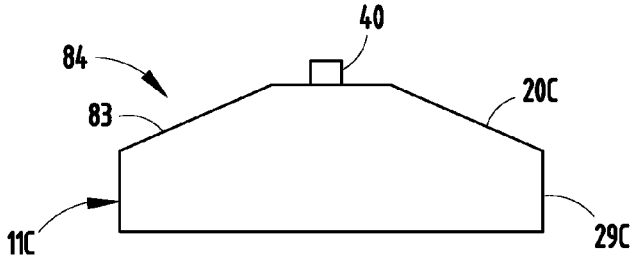
FIG. 16 is a side elevational view of another embodiment of an ice dispenser side profile configuration.
Figure 17:
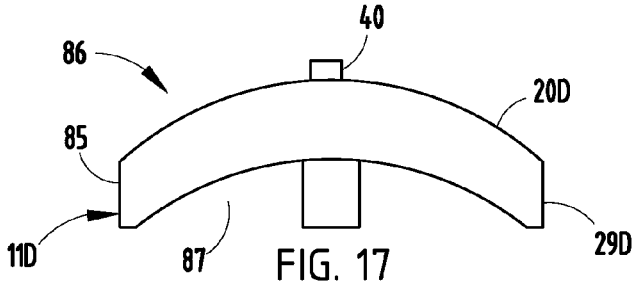
FIG. 17 is a side elevational view of another embodiment of an ice dispenser side profile configuration.
Figure 18:
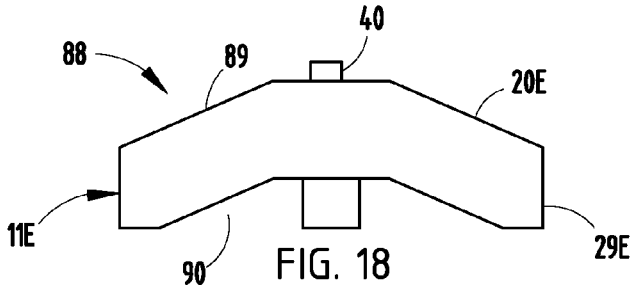
FIG. 18 is a side elevational view of another embodiment of an ice dispenser side profile configuration.

Referring now to FIGS. 14-18, the ice-containing member 11 may also have a variety of side profile configurations. As shown in FIG. 14, the ice-containing member 11A may have a standard cylindrical configuration 80 with a planar circular lid 20A and a cylindrical sidewall 29A. Alternatively, as shown in FIG. 15 the ice-containing member 11B has an arcuate top embodiment 82 includes a lid 20B that has an arcuate cross-section and which is disposed on a cylindrical sidewall 29B. This construction may accommodate a high ice volume. The slant top embodiment 84 shown in FIG. 16 includes ice-containing member 11C with a cylindrical sidewall 29C and a lid 20C with downwardly slanting walls 83 that also allow for increased capacity for storing ice 52. The arcuate construction 86 illustrated in FIG. 17 includes an ice-containing member 11D with a cylindrical sidewall 29D and a lid 20D with an arcuate cross section. An arcuate lower cavity area 87 is formed under the ice-containing member 11D which causes ice 52, under the force of gravity, to flow to the outside edges of the ice-containing member 11D. This functionality aids in directing ice 52 to the ice-dispensing aperture 18 during ice dispensing. FIG. 18 is similar to FIG. 17, but the lid 20E includes downwardly slanting walls on a cylindrical sidewall 29E. A lower cavity 90 is formed below the ice-containing member 11E.

It is contemplated that there may be stops disposed on the ice-containing member 10 that hold the ice-containing member 10 in position or a sensor that effectively locates the chambers in correct rotational alignment during an ice-dispensing event. The stops effectively locate the ice-receiving aperture in the lid 20 in position under an ice maker 32 and above a first chamber 12*a* while at the same time locating a second chamber 12*b* over the ice-dispensing aperture 18.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. An ice transfer device comprising:

an ice-containing member having a cylindrical exterior shape with a central axis and a plurality of chamber walls rotatable about the central axis;

a base disposed below the ice-containing member and having an ice-dispensing aperture;

a lid disposed above the ice-containing member, the lid being operable between a first position wherein the lid abuts the plurality of chamber walls and a second position where the lid is vertically offset at a predetermined distance from the plurality of chamber wall and including an ice-receiving aperture vertically offset from the ice-dispensing aperture;

wherein the plurality of moveable chamber walls extend substantially from the fixed base to an area adjacent the lid.

2. The ice transfer device of claim 1, further comprising:

a pivot pin disposed proximate the central axis.

3. The ice transfer device of claim 1, wherein the lid has an arcuate cross-section.

4. The ice transfer device of claim 1, wherein one of the plurality of chamber walls is disposed horizontally between the ice-receiving aperture and the ice-dispensing aperture.

5. The ice transfer device of claim 1, wherein the lid includes downwardly slanting walls.

6. The ice transfer device of claim 1, wherein the chamber walls have an arcuate shape.

7. The ice transfer device of claim 1, wherein the chamber walls have an offset portion.

8. The ice transfer device of claim 1, wherein the chamber walls include a flanged end.

9. The ice transfer device of claim 1, wherein each chamber wall includes an arcuate outer end that complements an interior circumferential area of the ice-containing member.

* * * * *